US006669467B2

(12) United States Patent
Kieswetter

(10) Patent No.: US 6,669,467 B2
(45) Date of Patent: Dec. 30, 2003

(54) GAS FIRED RADIANT HEATING UNIT AND METHOD OF OPERATION THEREOF

(75) Inventor: Robert E. Kieswetter, St. Clements (CA)

(73) Assignee: Heat Design Equipment Inc., Kitchener (CA)

( * ) Notice: Subject to any disclaimer, the term of this patent is extended or adjusted under 35 U.S.C. 154(b) by 0 days.

(21) Appl. No.: 10/260,552

(22) Filed: Oct. 1, 2002

(65) Prior Publication Data

US 2003/0213485 A1 Nov. 20, 2003

Related U.S. Application Data

(60) Provisional application No. 60/380,265, filed on May 15, 2002.

(51) Int. Cl.[7] ..... F23D 11/36; F23D 14/14; E01C 7/06; E01C 23/14

(52) U.S. Cl. ..... 431/154; 431/327; 431/329; 126/92 AC; 404/77; 404/95

(58) Field of Search ..... 431/327, 329, 431/154, 7; 126/92 R, 92 AC, 92 B; 404/77, 79, 95

(56) References Cited

U.S. PATENT DOCUMENTS

| | | | | | |
|---|---|---|---|---|---|
| 3,044,805 | A | * | 7/1962 | Lambert | 285/45 |
| 3,122,197 | A | * | 2/1964 | Saponara et al. | 431/329 |
| 3,785,763 | A | * | 1/1974 | Bratko | 431/328 |
| 4,039,275 | A | * | 8/1977 | McGettrick | 431/329 |
| 4,927,355 | A | * | 5/1990 | Haire et al. | 431/329 |
| 5,218,952 | A | * | 6/1993 | Neufeldt | 126/92 AC |
| 6,190,162 | B1 | * | 2/2001 | Smith et al. | 431/328 |

* cited by examiner

*Primary Examiner*—Henry Bennett
*Assistant Examiner*—James G. Barrow
(74) *Attorney, Agent, or Firm*—Daryl W. Schnurr

(57) ABSTRACT

A heating unit has a cartridge that constitutes a single component, which can be readily removed and replaced with a new cartridge. The cartridge is a plurality of non-flammable layers bound together in a border. The layers include a stainless steel mesh located above a layer of ceramic wool. With the cartridge, replacement can be accomplished in approximately fifty minutes compared to a downtime of a week or more previously.

2 Claims, 7 Drawing Sheets

GAS FIRED RADIANT HEATING UNIT AND METHOD OF OPERATION THEREOF

This application claims the benefit of Provisional Application Ser. No. 60/380,265 filed May 15, 2002.

BACKGROUND OF THE INVENTION

1. Field of Invention

This invention relates to an improved radiant heating unit and to an improved method of operation thereof. More particularly, this invention relates to a gas powered radiant heating unit that can be used with roadway surface reconditioning machines to heat various surfaces, including asphalt over a relatively large area.

2. Description of the Prior Art

It is known to have radiant heating units for use in repairing asphalt roadway surfaces. The units can be used with a scarifier or patcher. Most units are powered by low pressure propane gas. A radiant heating unit is described in U.S. Pat. No. 5,218,952 issued to Neufeldt on Jun. 15, 1993. The Neufeldt patent describes a radiant heating unit having a housing with a layer of ceramic fiber sandwiched between two layers of mesh. The heating unit described in the Neufeldt patent works well and is designed to withstand rough treatment. However, due to the extreme temperature conditions under which the heating unit operates, the mesh can fail or the ceramic fiber can become damaged. When this occurs, the housing portion of the unit must be returned to the manufacturer for refurbishing. The manufacturer then removes the old layers and replaces them with a new layer of ceramic fiber sandwiched between two new layers of mesh. This procedure takes approximately five to six hours for the manufacturer to complete, but the downtime for the unit to the user can easily be one to two weeks.

SUMMARY OF THE INVENTION

It is an object of the present invention to improve the heating unit described in U.S. Pat. No. 5,218,952 by allowing the unit to be repaired quickly on site, thereby virtually eliminating nearly all of the downtime required for the previous device. It is a further object of the present invention to provide a cartridge that is quickly and easily removable and replaceable within the unit on site, the cartridge including the layer of ceramic fibre.

A radiant heating unit has supply means for supplying a quantity of fuel in vapor form at a predetermined pressure. There are means to mix air into the fuel and a housing having a periphery surrounding an open bottom. A removable and replaceable cartridge is affixed to the periphery, the cartridge covering the open bottom with a skirt extending downward beyond the cartridge. The housing and the cartridge define a chamber and the cartridge separates the chamber from ambient air. The chamber is connected to receive a fuel/air mixture. The cartridge is removable and replaceable in the housing and contains multiple layers of non-flammable materials that are bound together into a single component. The layers are porous enough to allow the fuel/air mixture to flow through the cartridge at a rate so that combustion occurs at an outer surface of the cartridge.

A method of operating a radiant heating unit having a housing with an open bottom and a cartridge covering the open bottom with a skirt extending downward from the cartridge, the cartridge being sandwiched between the housing and skirt by retainers, the cartridge and housing defining a chamber, said method comprising the steps of commencing with a cartridge installed in the unit, when the cartridge becomes worn, removing the cartridge from the housing on site by removing the retainers, separating the skirt from the cartridge, and replacing the cartridge with a replacement cartridge and attaching the skirt to the housing with the cartridge sandwiched in between by reattaching the retainers.

DETAILED DESCRIPTION OF A PREFERRED EMBODIMENT

Figure 1:
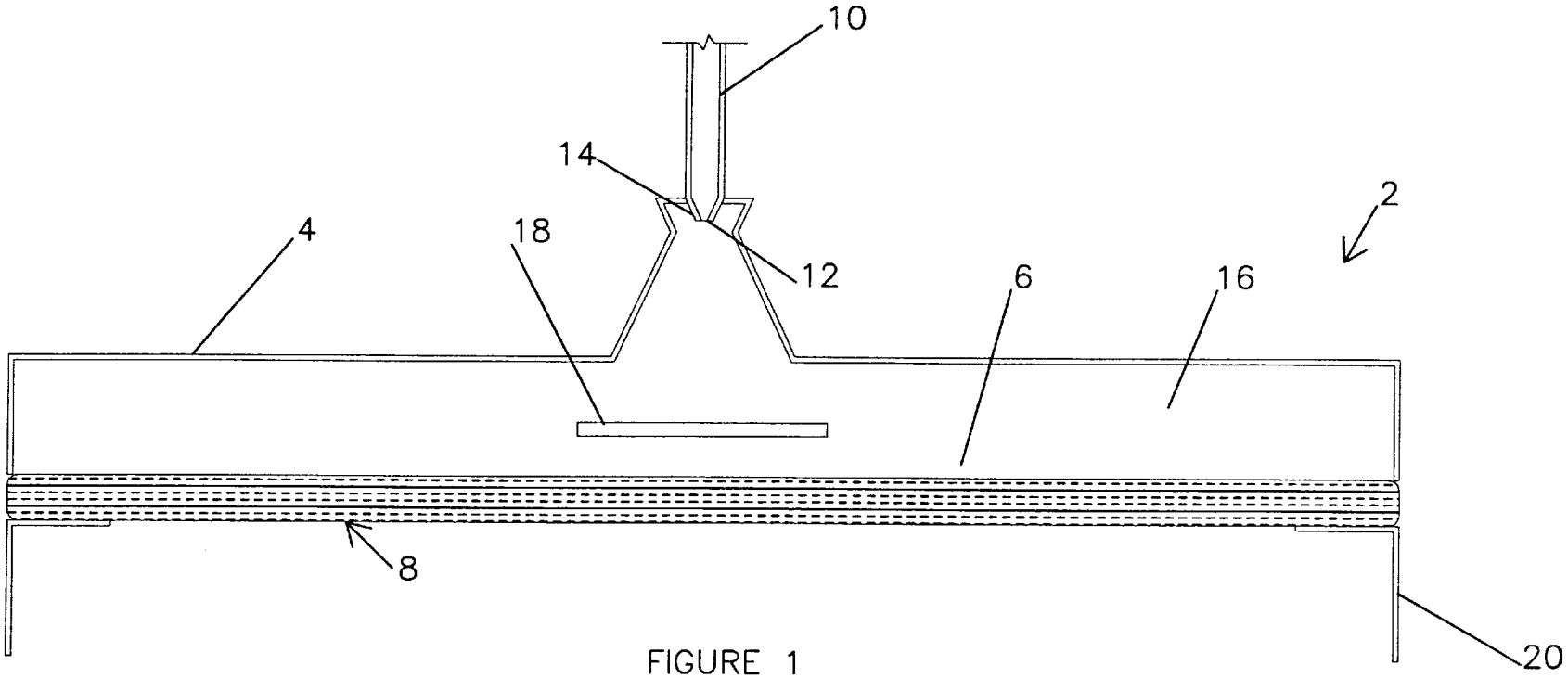
In FIG. 1, there is shown a schematic side view of a burner housing.

In FIG. 1, there is shown a burner 2 having a housing 4 with a bottom 6 covered by a cartridge 8. The housing can be referred to, more specifically, as a plenum. The burner 2 has a fuel supply line 10, which supplies a fuel mixture through an orifice 12 in a venturi 14. The housing 4 and cartridge 8 define a chamber 16. Within the chamber 16, there is located a deflector 18, which distributes the fuel/air mixture evenly into the cartridge 8. A skirt 20 extends downward from the cartridge 8. The skirt protects the cartridge from physical damage and maintains a minimum distance between the cartridge and a surface (not shown) to be heated. The cartridge 8 is sandwiched between the housing and the skirt.

Figure 2:
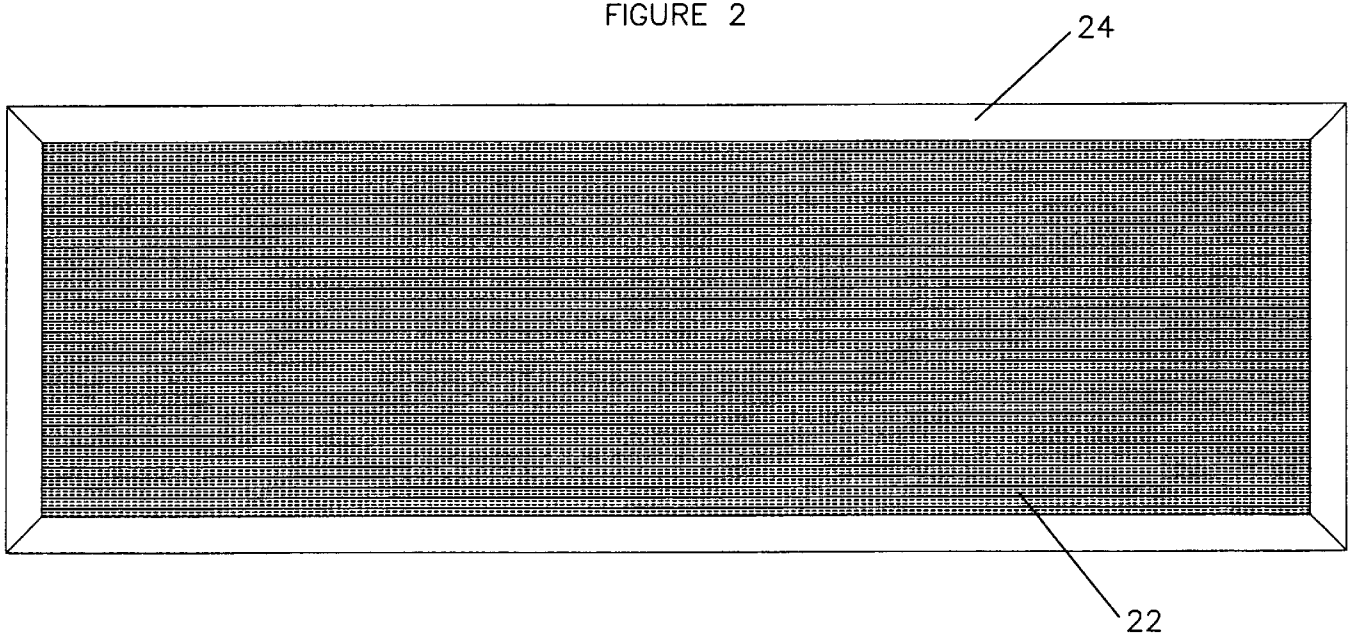
FIG. 2 is a top view of a cartridge.

In FIG. 2, it can be seen that the cartridge has a top layer 22 and a rigid border 24.

Figure 3:
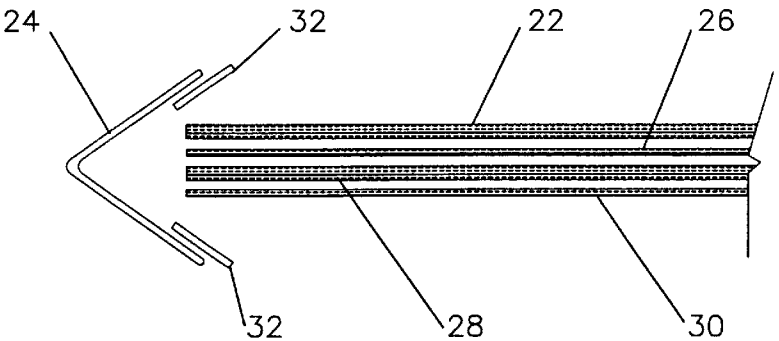
FIG. 3 is a partial sectional side view of the cartridge of FIG. 2.

In FIG. 3, it can be seen that the cartridge has four layers, a top layer 22 being an expandable metal screen, a second layer 26, located immediately beneath the top layer 22, made of stainless steel mesh (skein), a third layer 28, being an aluminum screen, located immediately beneath the second layer 26 and a bottom layer 30. The bottom layer 30 is made from ceramic wool. The layers are held together by the border 24, which is preferably crimped around the periphery of the layers 22, 26, 28, 30. Seals 32 are crimped between the border 24 and the top layer 22 and between the border 24 and the bottom layer 30 to prevent the fuel/air mixture (not shown) from leaking around the periphery of the layers. The cartridge is a single component.

Figure 4:
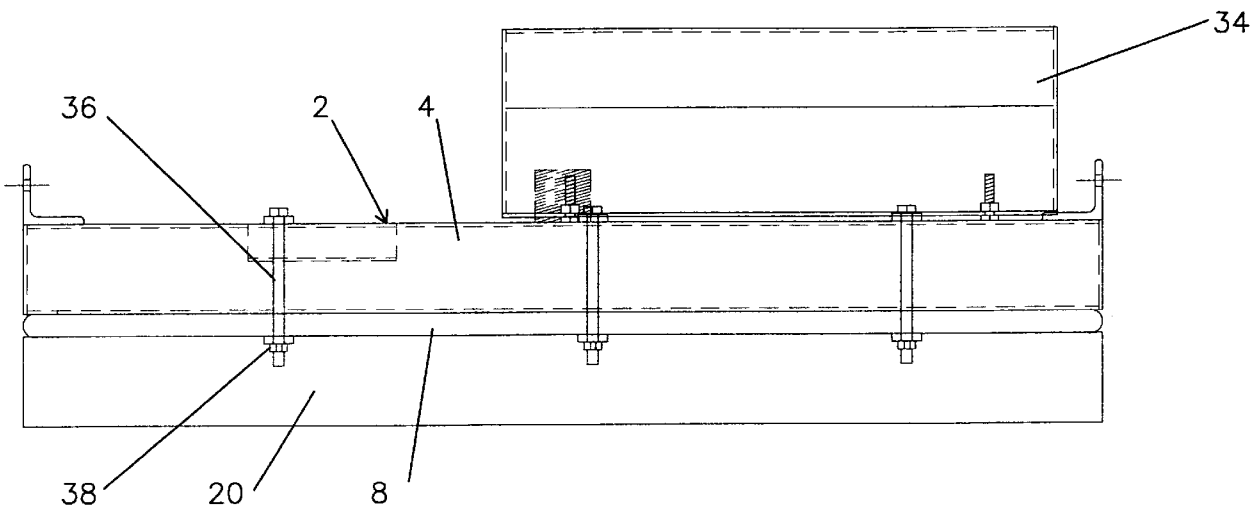
FIG. 4 is a side view of the housing with control means on top.
Figure 5:
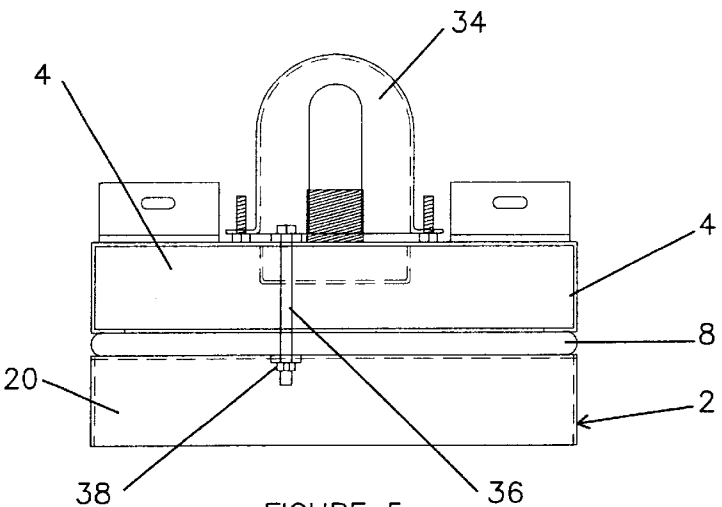
FIG. 5 is an end view of the housing with said control means on top.

In FIG. 4, there is shown a side view of the burner 2 with a venturi cover 34 mounted on top of the housing 4. It can be seen that the cartridge 8 is sandwiched between the housing 4 and the skirt 20 by bolts 36 and nuts 38. There are three bolts shown in FIG. 4, but there are preferably only eight bolts in total, three along each side of the housing 4 and one bolt at each end. It can be seen that FIG. 5 is an end view of the housing shown in FIG. 4. The same reference numerals are used in FIG. 5 as those used in FIG. 4 to describe those components that are identical to one another. The cartridge can be affixed between the housing and the skirt by retainers other than bolts. If bolts are used, the number of bolts could be more or less than eight.

Figure 6:
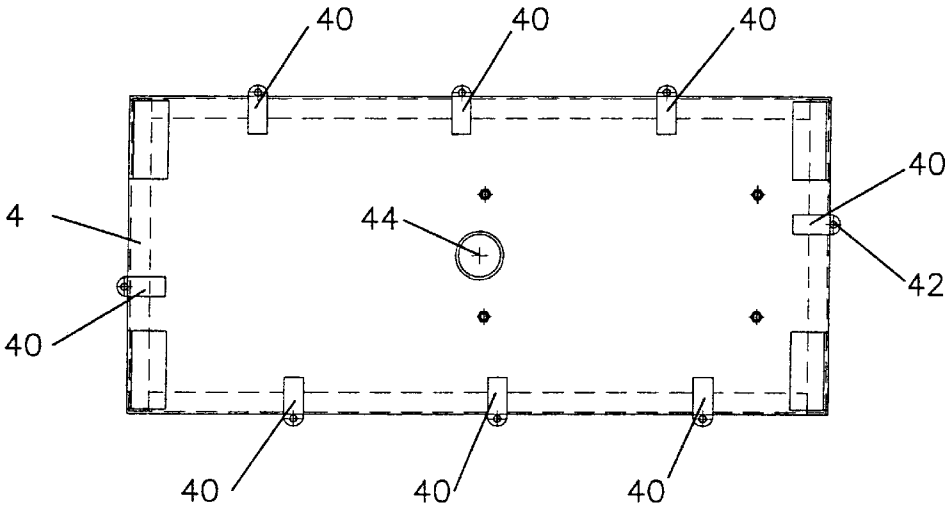
FIG. 6 is a top view of an upper section of the heater with the control means removed.
Figure 7:
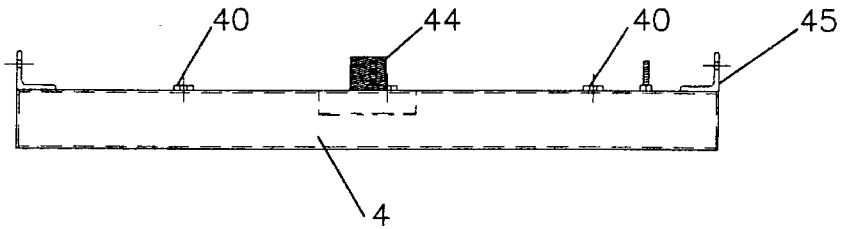
FIG. 7 is a side view of the upper section of the heater.
Figure 8:
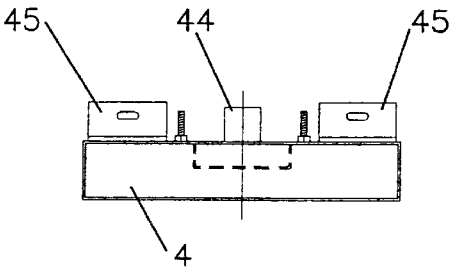
FIG. 8 is an end view of said upper section.

In FIG. 6, there is shown a top view of the housing 4 with the venturi cover 34 removed. It can be seen that there are eight clips 40 spaced around a periphery of the housing 4. Each of the clips 40 contains an opening 42 to receive one of the bolts 36 (not shown in FIG. 6). A fuel/air mixture inlet 44 is located approximately in the center of the housing 4. In FIG. 7, there is shown a side view of the housing shown in FIG. 6. Those components that are identical to the components shown in FIG. 6 are described using the same reference numerals. A flange 45 located at the top corners of the housing 4 serves as a mounting bracket. FIG. 8 is an end view of the housing shown in FIG. 7 and the same reference numerals are used in FIG. 8 as those used in FIG. 7 to refer to those components that are identical.

Figure 9:
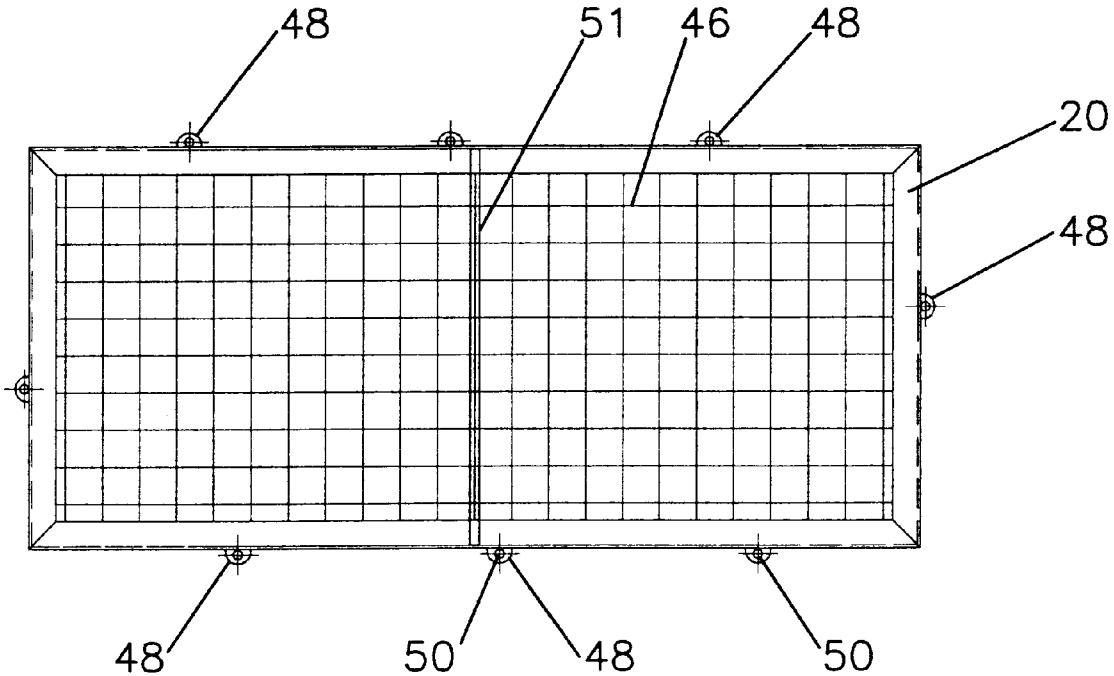
FIG. 9 is a top view of a lower skirt of the heater.

In FIG. 9, there is shown a top view of the skirt 20. It can be seen that an upper surface of the skirt 20 has a screen 46 affixed thereto. The screen 46 provides support to the cartridge 8 when the skirt is installed on the burner 2 with the cartridge sandwiched between the skirt 20 and the housing 4. More particularly, the screen 46 provides support to the ceramic wool layer or bottom layer 30 of the cartridge 8. It can also be seen that the skirt 20 has a periphery with eight lugs 48 spaced apart from one another and extending outward from the periphery of the skirt 20. Each of the lugs 48 contains an opening 50 to receive one of the bolts 36 (not shown in FIG. 9). A cross bar 51 provides stability to the skirt 20 and to the housing 4 so that the side walls do not flex outward. If the side walls of the housing and of the skirt were to flex outward the fuel/air mixture could escape from the chamber 16 outside of the border 24 of the cartridge 8 (not shown in FIG. 9).

Figure 10:
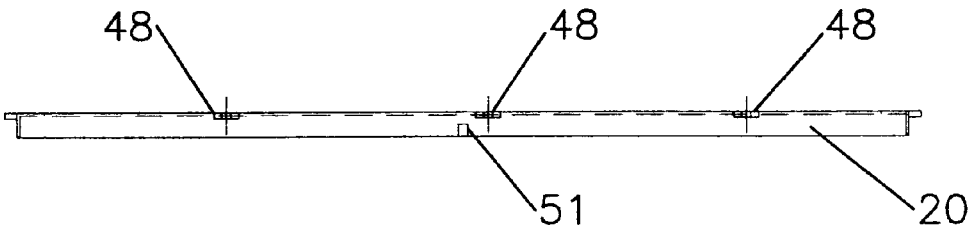
FIG. 10 is a schematic side view of one embodiment of the heating unit including the fuel supply.

FIG. 10 is a side view of the skirt shown in FIG. 9. The same reference numerals are used in FIG. 10 to describe those components that are identical to the components of FIG. 9.

Figure 11:
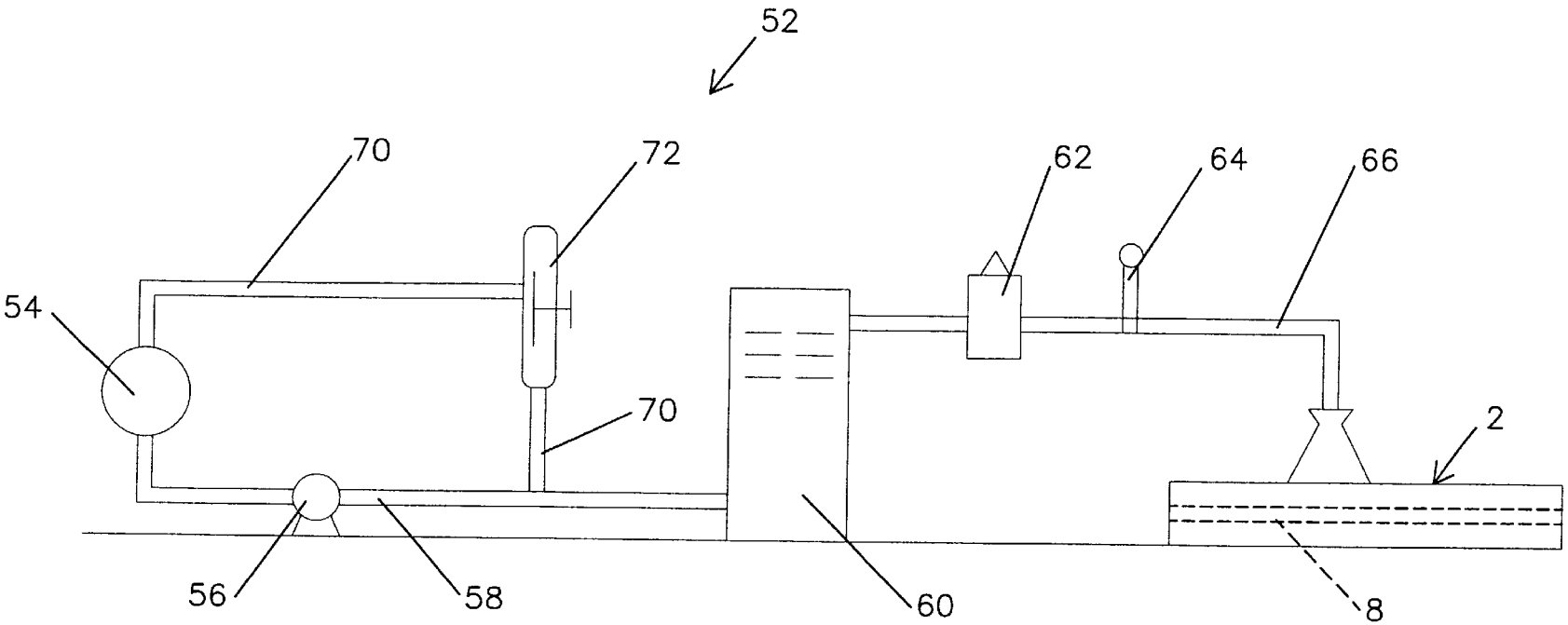
FIG. 11 is a schematic side view of one embodiment of the heating unit including the fuel supply.

In FIG. 11, there is a schematic side view of a heating unit 52. The heating unit, 52 has a propane tank 54 (i.e. a fuel supply) from which liquid propane is drawn by a pump 56 through a supply pipe 58 to a vaporizer 60. The propane gas from the output of the vaporizer 60 passes through a control regulator 62 where the pressure of the gas is reduced from approximately 100 psi. to between 30 and 80 psi as indicated by a gauge 64. The propane gas continues through a supply line 66 into the burner 2 through the venturi (not shown in FIG. 11). The gas pressure passing through the venturi entrains air at the proper air/gas ratio for complete combustion. Liquid propane at a pressure above approximately 100 psi is returned to the propane tank 54 through a liquid return pipe 70 and bypass valve 72.

Figure 12:
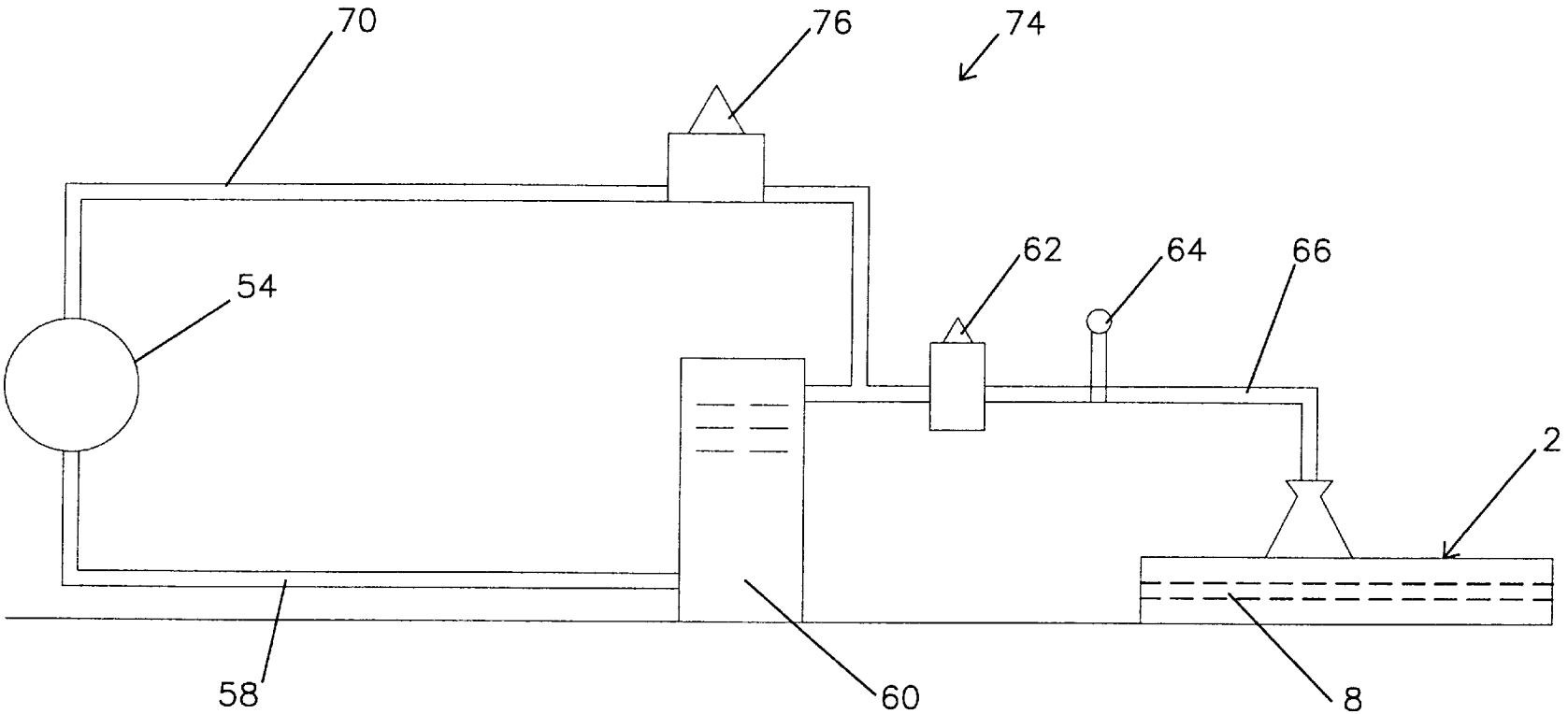
FIG. 12 is a schematic side view of another embodiment of the heating unit including the fuel supply.

In FIG. 12, there is shown a schematic side view of a further embodiment of a heating unit 74. The heating unit 74 does not require the use of a pump. Those components of FIGS. 11 and 12 that are identical to the components described in FIG. 1 are referred to using the same reference numerals as those used in FIG. 1. Those components referred to in FIG. 12 that are identical to the components of FIG. 11 are described using the same reference numerals as those used in FIG. 11. In FIG. 12, the propane tank 54 feeds liquid propane by gravity through supply pipe 58 into the vaporizer 60. A portion of the high pressure vaporized propane gas at the output of the vaporizer 60 passes through a regulator 76 set at 100 psi and returns to the propane tank through a vapor return pipe 70. The regulator 76 will shut off automatically when the pressure of the propane gas has reached 100 psi. Therefore, the liquid propane is forced into pipe 58 by the high pressure gaseous propane at the top of tank 54. If the pressure of the gaseous propane drops below 100 psi, the regulator 76 is opened again to force additional liquid propane into the supply pipe 58, which will eventually return the pressure of the vaporized propane gas to 100 psi.

A majority of the gaseous propane from the output of the vaporizer 60 is passed through control regulator 62, which reduces the pressure of the gaseous propane from 100 psi to between 30 and 80 psi as indicated by the gauge 64. The propane gas continues through the supply line 66 into the burner 2 through the venturi (not shown in FIG. 12).

Preferably, the cartridge 8 is in one piece. The fact that the cartridge is held in place by only eight bolts (with corresponding nuts) allows the cartridge to be removed and replaced quickly (i.e. in less than fifteen minutes).

The stainless steel mesh layer of the cartridge is similar to steel wool and can be referred to as a skein. The skein prevents any flame that gets through the ceramic fiber or wool from passing further through the cartridge into the chamber 16. If the ceramic wool fails, the stainless steel skein quenches the combustion of the air/propane mixture and prevents the ignition of the air/propane mixture within the chamber, thereby protecting the burner from damage. While propane is the preferred fuel, other liquid hydrocarbon fuels that can be readily vaporized will be suitable. For example, butane, pentane, ethane, methane or combinations with other fuels will be suitable.

I claim:

1. A method of operating a radiant heating unit having a housing with an open bottom and a cartridge covering said bottom with a skirt extending downward from said cartridge, said cartridge being sandwiched between said housing and said skirt by retainers, said cartridge and housing defining a chamber, said method comprising the steps of commencing with a cartridge installed in said unit, when said cartridge becomes worn, removing said cartridge from said housing on site by removing said retainers, separating said skirt from said cartridge, replacing said cartridge with a replacement cartridge and attaching said skirt to said housing with said cartridge sandwiched in between reattaching said retainers.

2. A method of operating a radiant heating unit as claimed in claim 1 wherein said cartridge is held in place between said housing and said skirt by a maximum of eight retainers, said method comprising the steps of opening said retainers, removing said skirt and said cartridge, replacing said cartridge with a replacement cartridge and closing said retainers after installing said replacement cartridge and said skirt.

* * * * *